US006597127B2

(12) United States Patent
Takahashi et al.

(10) Patent No.: US 6,597,127 B2
(45) Date of Patent: Jul. 22, 2003

(54) DISCHARGE LAMP OPERATING APPARATUS, SELF-BALLASTED DISCHARGE LAMP, DIMMER AND ILLUMINATION KIT FOR DIMMING

(75) Inventors: Kenichiro Takahashi, Katano (JP); Satoshi Kominami, Katano (JP); Masayoshi Gyoten, Otsu (JP); Koji Miyazaki, Hirakata (JP); Mamoru Takeda, Soraku-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/962,934

(22) Filed: Sep. 25, 2001

(65) Prior Publication Data

US 2002/0047608 A1 Apr. 25, 2002

(30) Foreign Application Priority Data

Sep. 29, 2000 (JP) ..... 2000-300036

(51) Int. Cl.[7] ..... H05B 37/02

(52) U.S. Cl. ..... 315/224; 315/291; 315/307; 315/DIG. 4

(58) Field of Search ..... 315/224, 225, 315/209 R, 291, 307, 311, DIG. 4

(56) References Cited

U.S. PATENT DOCUMENTS

RE31,146 E * 2/1983 Gyursanszky ..... 315/276
4,540,917 A * 9/1985 Luchaco et al. ..... 315/291
5,757,145 A * 5/1998 Johnson et al. ..... 315/308
6,043,611 A * 3/2000 Gradzki et al. ..... 315/194
6,114,813 A * 9/2000 Lo et al. ..... 315/159
6,144,169 A * 11/2000 Janczak ..... 315/224

FOREIGN PATENT DOCUMENTS

JP 09148081 A 6/1997
JP 09283289 A 10/1997
JP 10106775 A 4/1998
JP 10106777 A 4/1998
JP 11111486 A 4/1999

* cited by examiner

*Primary Examiner*—Don Wong
*Assistant Examiner*—Tuyet T. Vo
(74) *Attorney, Agent, or Firm*—Harness, Dickey & Pierce, PLC

(57) ABSTRACT

A discharge lamp operating apparatus includes a discharge lamp; a dimmer for performing phase-control with respect to an input power source; and a ballast circuit for dimming and operating the discharge lamp in accordance with an AC voltage that is phase-controlled by the dimmer. A relationship $$Z2 \leqq (Vin/Vob-1) \times Z1;$$

is satisfied, where Z1 (Ω) is an impedance between an input terminal and an output terminal of the dimmer, Vob (V) is a breakover voltage of a bidirectional trigger diode that applies a trigger signal and is connected to a gate terminal of a switching element included in the dimmer, Vin (V) is an effective voltage of a commercial power source, and Z2 (Ω) is an input impedance between the input terminals of the ballast circuit.

13 Claims, 9 Drawing Sheets

DISCHARGE LAMP OPERATING APPARATUS, SELF-BALLASTED DISCHARGE LAMP, DIMMER AND ILLUMINATION KIT FOR DIMMING

BACKGROUND OF THE INVENTION

The present invention relates to discharge lamp operating apparatuses, self-ballasted discharge lamps, dimmers and illumination kits for dimming. In particular, the present invention relates to operating apparatuses that dim fluorescent lamps, for example, with a dimmer for incandescent lamps.

Fluorescent lamps are characterized by high efficiency and long life, compared with incandescent lamps, so that they are widely used. In particular, a self-ballasted fluorescent lamp in which a fluorescent lamp and a ballast circuit are integrally formed can be mounted on a socket for an incandescent lamp without any modification, so that the need for self-ballasted fluorescent lamps is increasing in view of energy saving and resources saving.

In recent years, there is an increasing demand for self-ballasted fluorescent lamps that can be dimmed with a dimmer for an incandescent fluorescent lamp as in incandescent lamps, so that dimmable self-ballasted fluorescent lamps are under development. To dim an incandescent lamp, a method generally used is as follows. A commercial power source is turned on and off with a dimmer, and an AC voltage that is phase-controlled in such a manner that the ON period is changed is input thereto. On the other hand, to dim a self ballasted fluorescent lamp, a ballast circuit to which a phase-controlled AC voltage is input and that allows dimming and operation is required.

An example of the discharge lamp operating apparatus to which a phase-controlled AC voltage is input and that dims and operates a fluorescent lamp is one disclosed in Japanese Laid-Open Patent Publication No. 11-111486. The discharge lamp operating apparatus disclosed in the publication changes the brightness of the fluorescent lamp in accordance with the conduction period (ON period) of an input phase-controlled AC voltage. FIG. 9 shows the configuration of this discharge lamp operating apparatus.

The discharge lamp operating apparatus shown in FIG. 9 includes a phase control device 102 connected to a commercial power source 101, a high frequency generating device 103, and a fluorescent lamp 108, and further includes detecting means 109 for detecting a conduction angle of a phase-controlled voltage from the phase control device 102 and photodetecting means 110 for detecting an optical output of the fluorescent lamp 108. The high frequency generating device 103 includes a high frequency blocking filter 104, a rectifying device 105, a smoothing DC voltage converter 106, and inverter portion 107. The inverter portion 107 includes a switching portion 171 and a transmission control portion 172 of the switching portion 171. The detecting means 109 changes the output frequency of the transmission control portion 172 of the inverter portion 107 in accordance with the detected conduction angle. On the other hand, the photodetecting means 110 changes the output frequency of the transmission control portion 172 in accordance with the detected output.

For dimming and operation of a dimmable fluorescent lamp, a commercially available dimmer for an incandescent lamp is often used as the phase control device 102. Although in principle, any commercially available dimmers should perform a dimming operation stably, the operation tests conducted by the inventors of the present invention confirmed that operational malfunction occurred in some cases. For example, when an operation of turning on, then turning off, and then turning off is performed with a dimmer, some dimmers are operated successfully, but other dimmers fail to turn on again and stay off. Such malfunction does not generally occur in dimming of incandescent lamps and thus it becomes one factor that prevents dimmable fluorescent from becoming popular.

SUMMARY OF THE INVENTION

Therefore, with the foregoing in mind, it is a main object of the present invention to provide a discharge lamp operating apparatus that can achieve a stable dimming operation from full light state to light-off state.

A discharge lamp operating apparatus of the present invention includes a discharge lamp; a dimmer for performing phase-control with respect to an input power source; and a ballast circuit for dimming and operating the discharge lamp in accordance with an AC voltage that is phase-controlled by the dimmer. A relationship $$Z2 \leqq (Vin/Vob-1) \times Z1$$

is satisfied, where Z1 (Ω) is an impedance between an input terminal and an output terminal of the dimmer, Vob (V) is a breakover voltage of a bidirectional trigger diode that applies a trigger signal and is connected to a gate terminal of a switching element included in the dimmer, Vin (V) is an effective voltage of a commercial power source, and Z2 (Ω) is an input impedance between the input terminals of the ballast circuit.

It is preferable that the upper limit of the Z2 (Ω) is 54 KΩ.

It is preferable that the upper limit of the Z2 (Ω) is 26 KΩ.

In one embodiment, a first capacitor is connected between the input terminals of the ballast circuit, and the first capacitor has a function of setting a value of the Z2 (Ω).

In one embodiment, a series circuit including a second capacitor and a resistor is connected between the input terminals of the ballast circuit, and the series circuit has a function of setting a value of the Z2 (Ω).

It is preferable that the lower limit of the resistance of the resistor is 1 KΩ.

In one embodiment, the ballast circuit comprises a high frequency blocking filter including an inductance element and a capacitor, and the second capacitor is the capacitor included in the high frequency blocking filter.

In one embodiment, the discharge lamp operating apparatus further includes a lamp base, wherein the lamp base, the ballast circuit, and the discharge lamp are integrally formed.

In one embodiment, the dimmer is a dimmer for an incandescent lamp.

Another discharge lamp operating apparatus of the present invention includes a discharge lamp; a dimmer for performing phase-control with respect to an input power source; and a ballast circuit for dimming and operating the discharge lamp in accordance with an AC voltage that is phase-controlled by the dimmer. A series circuit including a capacitor and a resistor is connected between the input terminals of the ballast circuit, and the series circuit has a function of preventing ringing current that can be generated during dimming.

In one embodiment, the resistor has a resistance of 1 KΩ or more, and a relationship $$Z2 \leqq (Vin/Vob-1) \times Z1$$

is satisfied, where Z1 (Ω) is an impedance between an input terminal and an output terminal of the dimmer, Vob (V) is a breakover voltage of a bidirectional trigger diode that applies a trigger signal and is connected to a gate terminal of a switching element included in the dimmer, Vin (V) is an effective voltage of a commercial power source, and Z2 (Ω) is an input impedance between the input terminals of the ballast circuit.

A self-ballasted discharge lamp of the present invention includes a discharge lamp, a ballast circuit and a lamp base that are integrally formed. The self-ballasted discharge lamp is a lamp for dimming used in combination of a dimmer for performing phase control with respect to an input power source, the ballast circuit performs dimming and operation in accordance with an AC voltage that is phase-controlled by the dimmer, and a relationship $$Z2 \leqq (Vin/Vob-1) \times Z1$$

is satisfied, where Z1 (Ω) is an impedance between an input terminal and an output terminal of the dimmer, Vob (V) is a breakover voltage of a bidirectional trigger diode that applies a trigger signal and is connected to a gate terminal of a switching element included in the dimmer, Vin (V) is an effective voltage of a commercial power source, and Z2 (Ω) is an input impedance between the input terminals of the ballast circuit.

In one embodiment, the discharge lamp is a fluorescent lamp having a phosphor in one portion thereof. The upper limit of the Z2 (Ω) is 54 KΩ. A series circuit including a capacitor and a resistor is connected between the input terminals of the ballast circuit, and the Z2 (Ω) is set by the series circuit. The lower limit of a resistance of the resistor is 1 KΩ.

A dimmer of the present invention performs phase control with respect to an input power source, and supplies a phase-controlled AC voltage to a ballast circuit electrically connected to a discharge lamp. A relationship $$Z2 \leqq (Vin/Vob-1) \times Z1$$

is satisfied, where Z1 (Ω) is an impedance between an input terminal and an output terminal of the dimmer, Vob (V) is a breakover voltage of a bidirectional trigger diode that applies a trigger signal and is connected to a gate terminal of a switching element included in the dimmer, Vin (V) is an effective voltage of a commercial power source, and Z2 (Ω) is an input impedance between the input terminals of the ballast circuit.

An illumination set for dimming of the present invention includes a self-ballasted discharge lamp including a discharge lamp, a ballast circuit, and a lamp base that are integrally formed; and a dimmer combined with the self-ballasted discharge lamp. The dimmer is an external phase control apparatus for performing phase control with respect to an input power source, and supplying a phase-controlled AC voltage to the ballast circuit. The ballast circuit in the self-ballasted discharge lamp has a configuration for performing dimming and operation in accordance with the AC voltage that is phase-controlled by the dimmer, and a relationship $$Z2 \leqq (Vin/Vob-1) \times Z1$$

is satisfied, where Z1 (Ω) is an impedance between an input terminal and an output terminal of the dimmer, Vob (V) is a breakover voltage of a bidirectional trigger diode that applies a trigger signal and is connected to a gate terminal of a switching element included in the dimmer, Vin (V) is an effective voltage of a commercial power source, and Z2 (Ω) is an input impedance between the input terminals of the ballast circuit.

The present invention is configured such that the relationship $$Z2 \leqq (Vin/Vob-1) \times Z1$$

is satisfied and therefore a discharge lamp operating apparatus that can achieve a stable dimming operation from the full light state to the off-light state can be provided. Furthermore, a self-ballasted discharge lamp that is ensured of such a stable dimming operation, a dimmer used in that lamp, and an illumination set for dimming of the self-ballasted discharge lamp and the dimmer also can be provided. In addition, when a series circuit including a capacitor and a resistor is connected between the input terminals of the ballast circuit, the ringing current that can be generated during dimmer can be prevented. As a result, the dimmer can operate without malfunction due to ringing, so that a stable dimming operation from full light to off-light can be guaranteed in a comparatively simple circuit configuration.

This and other advantages of the present invention will become apparent to those skilled in the art upon reading and understanding the following detailed description with reference to the accompanying figures.

DETAILED DESCRIPTION OF THE INVENTION

Figure 1:
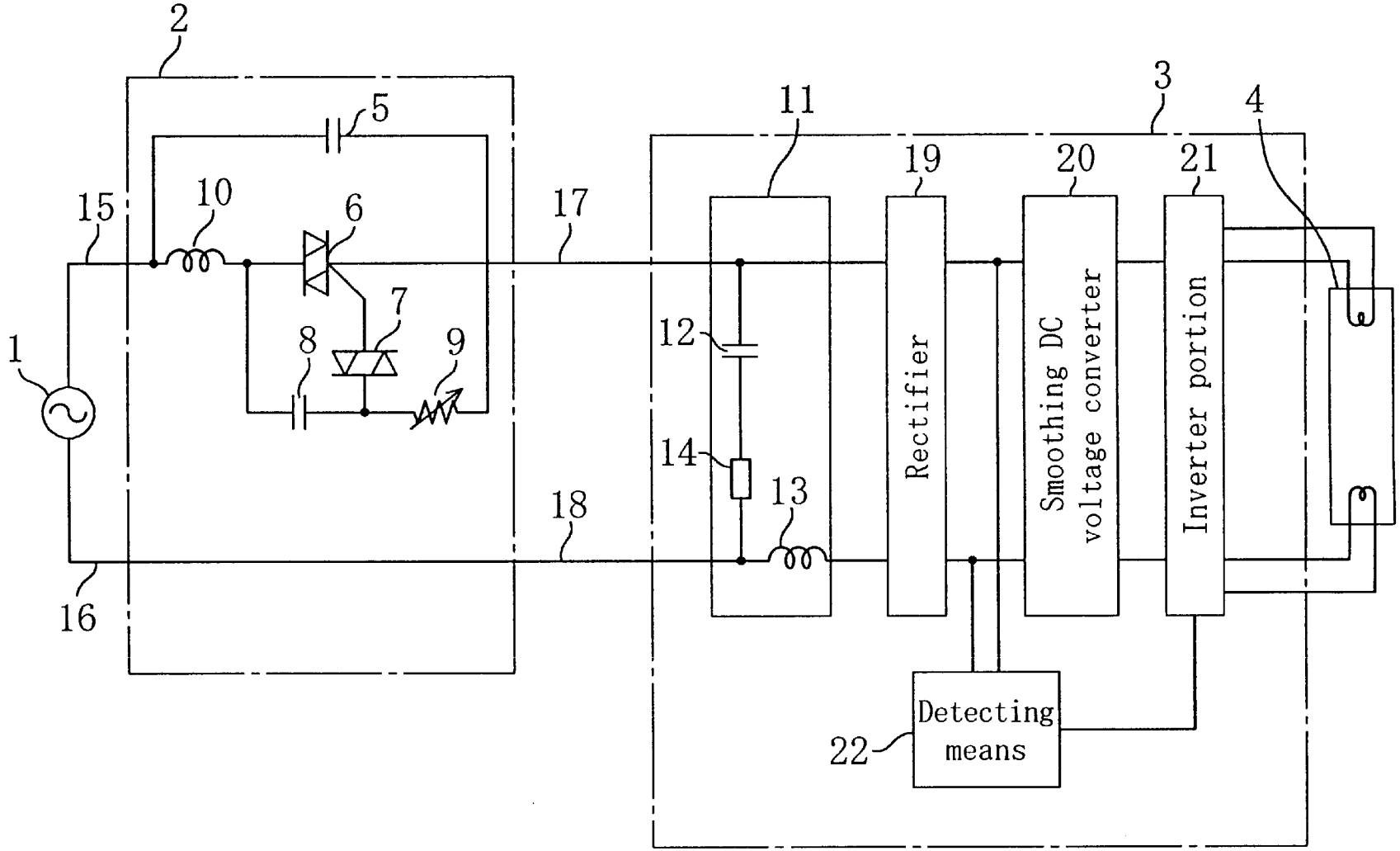
FIG. 1 is a view showing the configuration of a discharge lamp operating apparatus of an embodiment of the present invention.

Hereinafter, embodiments of the present invention will be described with reference to the accompanying drawings. For simplification, the components having substantially the same function bear the same reference numeral.

First, FIG. 1 is referred to. FIG. 1 is a schematic view showing the configuration of a discharge lamp operating apparatus of an embodiment of the present invention.

The discharge lamp operating apparatus of the present embodiment includes, a discharge lamp 4, a dimmer 2 for performing phase-control with respect to an input power source 1, and a ballast circuit 3 for dimming and operating the discharge lamp 4 in accordance with the AC voltage that is phase-controlled by the dimmer 2. Moreover, the discharge lamp operating apparatus of the present embodiment is configured such that the relationship $$Z2 \leqq (Vin/Vob-1) \times Z1$$

is satisfied, where Z1 (Ω) is the impedance between an input terminal 15 and an output terminal 17 of the dimmer 2, Vob (V) is the breakover voltage of a bidirectional trigger diode 7 that applies a trigger signal and is connected to a gate terminal of a switching element (triac) 6 included in the dimmer 2, Vin (V) is the effective voltage of the commercial power source 1, and Z2 (Ω) is the input impedance between the input terminals of the ballast circuit 3. This will be described more specifically below.

The commercial power source 1 is an AC power, for example, with 60 Hz and 100 V and is connected to the dimmer 2. The dimmer 2 includes a triac 6, which is a switching element, a bidirectional trigger diode 7 for applying a trigger signal to the gate of the triac 6, a capacitor 8 and a variable resistor 9 for adjusting the phase for generating the trigger signal of the bidirectional trigger diode 7, a capacitor 5 and an inductance element 10 that constitute a high frequency noise filter. As the dimmer 2, a dimmer for an incandescent lamp can be used.

The ballast circuit 3 includes a high frequency blocking filter 11, a rectifier 19, a smoothing DC voltage converter 20, an inverter portion 21, and detecting means 22. The discharge lamp 4 is connected to the ballast circuit 3 such that it is forced by an output of the ballast circuit 3 and the electrodes are preheated and/or heated. The discharge lamp 4 is, for example, a fluorescent lamp. However, not only a fluorescent lamp but also a discharge lamp such as an HID lamp can be used.

The operation of the discharge lamp operating apparatus shown in FIG. 1 will be described briefly. The capacitor 8 is charged via the variable resistor 9 in accordance with the output voltage from the AC power source 1. Then, when the voltage at both terminals of the capacitor 8 reaches the breakover voltage of the bidirectional trigger diode 7, the charges stored in the capacitor 8 are discharged through the bidirectional trigger diode 7. The obtained pulse signal here triggers the triac 6, so that the triac 6 is caused to be on with respect to the remaining portion of a half cycle of the AC power source 1 after the trigger. Therefore, the phase-controlled AC voltage is supplied from the dimmer 2 to the ballast circuit 3 by changing the resistance of the variable resistor 9.

The phase-controlled voltage from the dimmer 2 is input to the rectifier 19 via the high frequency blocking filter 11. The output voltage of this rectifier 19 is converted to a smoothed DC voltage in the smoothing DC voltage converter 20. Furthermore, the smoothed DC voltage is converted to a high frequency AC power in the inverter portion 21, and applied to the discharge lamp 4, so that the discharge lamp 4 is continuously on. The detecting means 22 detects a conduction angle of the phase-controlled voltage and an output of the inverter portion 21 is controlled by a signal corresponding to this conduction angle, so that the high frequency output of the ballast circuit 3 is changed. For this reason, the discharge lamp 4 is dimmed and operated in accordance with the phase angle of the AC voltage that is phase-controlled by the dimmer 2.

The high frequency blocking filter 11 serves to block high frequency noise from flowing out of the input terminal. In this embodiment, the high frequency blocking filter 11 has a comparatively simple circuit configuration including a capacitor 12, an inductance element 13 and the like.

Herein, the following can be understood: the impedance between an input terminal 15 and an output terminal 17 of the dimmer 2 is taken as Z1 (Ω), the input impedance of the ballast circuit 3 is taken as Z2 (Ω), and the voltage of the AC power source 1 is taken as Vin (V), as described above. In this case, a voltage represented by Vin×Z1/(Z1+Z2) is applied between the input terminal 15 and the output terminal 17 of the dimmer. In other words, unless this voltage is equal to the breakover voltage of the bidirectional trigger diode 7 or more, the triac 6 cannot be triggered so that the dimmer 2 cannot be operated. Therefore, when $$Vin \times Z1/(Z1+Z2) \geqq Vob$$

is satisfied, where Vob (V) is the breakover voltage of the bidirectional trigger diode 7, the dimmer 2 can be operated.

From the above equation, $$Z2 \leqq (Vin/Vob-1) \times Z1$$

is derived. The dimmer 2 is operated when the impedance Z2 of the ballast circuit 3 satisfies this inequality. The reason why the dimming operation was not complete in the past seems that this aspect was overlooked. As a result of experiments of the inventors of the present invention on various dimmers, it was confirmed that when the above-described relationships are satisfied, the dimmer 2 is operated. Wherein, it is more preferable that (Vin/Vob−1)×Z1 exceeds Z2, namely to satisfy the relationship of $$Z2 < (Vin/Vob-1) \times Z1.$$

Figure 2:
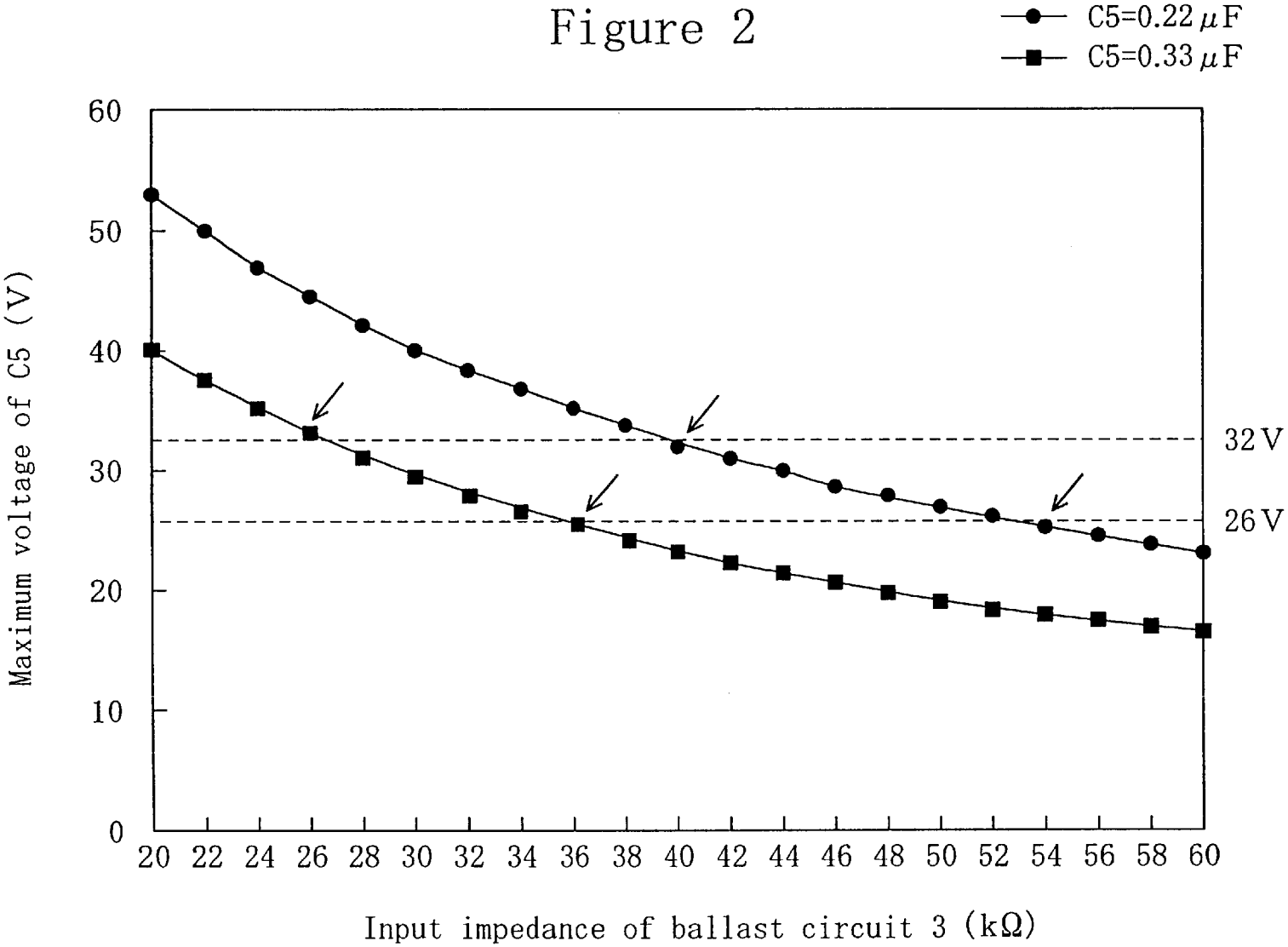
FIG. 2 is a graph showing the maximum voltage value of a capacitor with respect to the input impedance of a ballast circuit 3.

In the configuration shown in FIG. 1, as the capacitor 5 of the dimmer 2, a capacitor with a capacitance of 0.22 μF to 0.33 μF is used as a standard example. FIG. 2 shows the results of a calculation of the maximum voltage value at both terminals of the capacitor 5 with the input impedance of the ballast circuit 3 as the parameter and the capacitor 5 with 0.22 μF to 0.33 μF, using a commercial power source of 60 Hz and 100 Vrms.

In FIG. 2, the upper limits as the input impedance of the ballast circuit 3 at 26 V and 32 V of the breakover voltage of the bidirectional trigger diode 7 are found to be the values at the intersections shown by arrows. Thus, FIG. 2 indicates that preferable input impedances Z2 (Ω) between the input terminals of the ballast circuit 3 are those satisfying the following (i) to (iv).

(i) Z2≦54 KΩ, when the capacitance of the capacitor 5 between the input terminal 15 and the output terminal 17 of the dimmer 2 is 0.22 μF, and the breakover voltage of the bidirectional trigger diode 7 is 26V.

(ii) Z2≦40 KΩ, when the capacitance of the capacitor 5 is 0.22 μF, and the breakover voltage of the bidirectional trigger diode 7 is 32V.

(iii) Z2≦36 KΩ, when the capacitance of the capacitor 5 is 0.33 μF, and the breakover voltage of the bidirectional trigger diode 7 is 26V.

(iv) Z2≦26 KΩ, when the capacitance of the capacitor 5 is 0.33 μF, and the breakover voltage of the bidirectional trigger diode 7 is 32V.

The upper limit of Z2 of 26 KΩ ensures stable dimming operation with any of the commonly used dimmers, in practice. This leads to advantages in production and cost, because it can be achieved with a simple circuit configuration.

Figure 3:
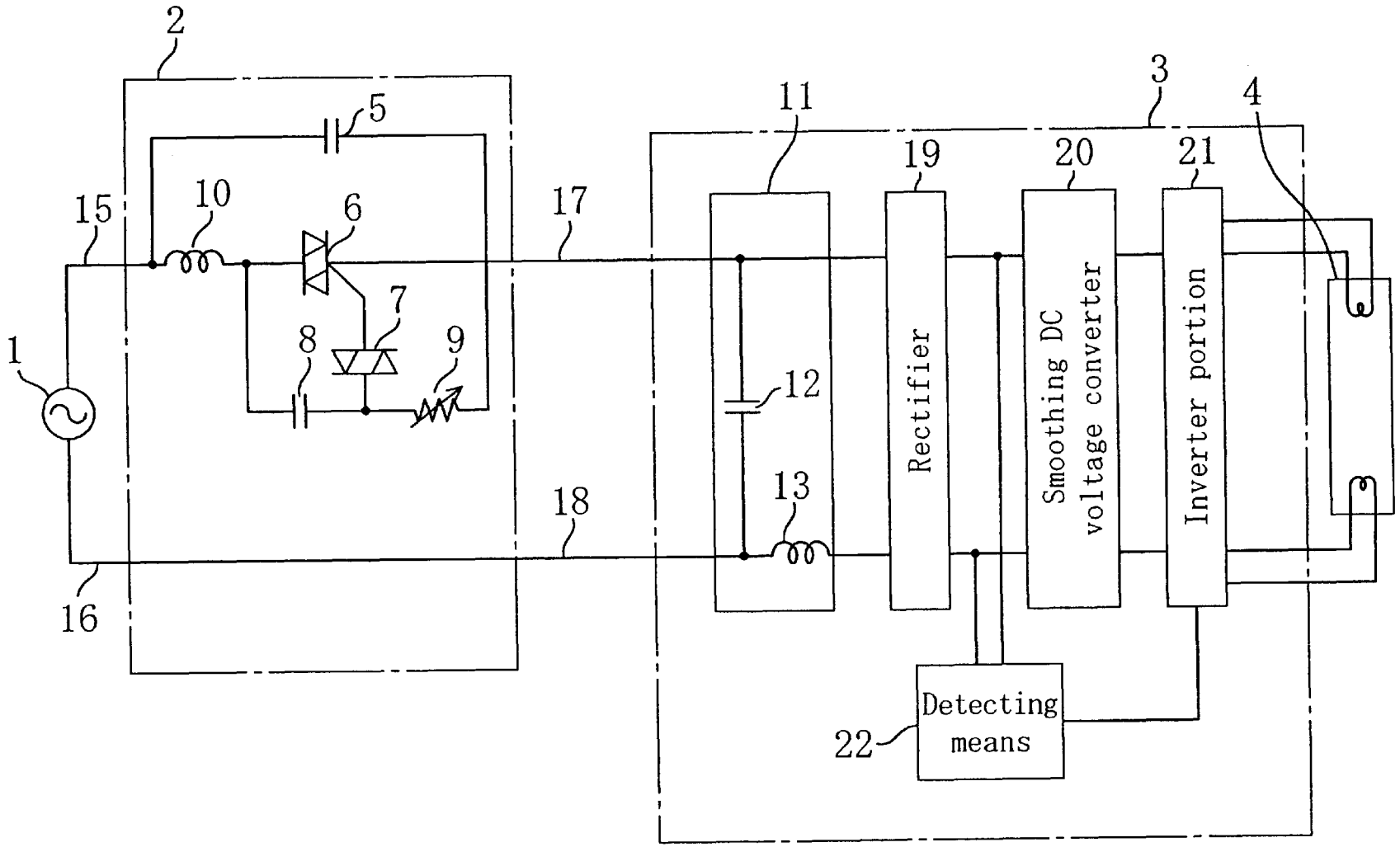
FIG. 3 is a view showing the configuration of a variation of the discharge lamp operating apparatus of an embodiment of the present invention.

The configuration shown in FIG. 1 is turned to the configuration shown in FIG. 3, when the resistor 14 is 0Ω. The high frequency blocking filter 11 can exert its function without the resistor 14. In the configuration shown in FIG. 3, the input impedance of the ballast circuit 3 can be set only by the capacitor 12 positioned between the input terminals of the ballast circuit 3. Describing more in detail, the dimmer 2 can be operated reliably when the impedance obtained by $$Z2=1/(2\pi\times f\times C),$$

where f (Hz) is the frequency of the AC power source 1, and C (F) is the capacitance of the capacitor 12, is equal to or less than the above upper limits (e.g., 54 KΩ, 40 KΩ, 36 KΩ, and 26 KΩ).

As in the configuration shown in FIG. 1 (i.e., the resistor 14 is not 0Ω), in the case where the input impedance Z2 of the ballast circuit 3 is set by a series circuit of the capacitor 12 and the resistor 14, it can be set with the synthesized impedance of the capacitor 12 and the resistor 14.

Figure 4A:
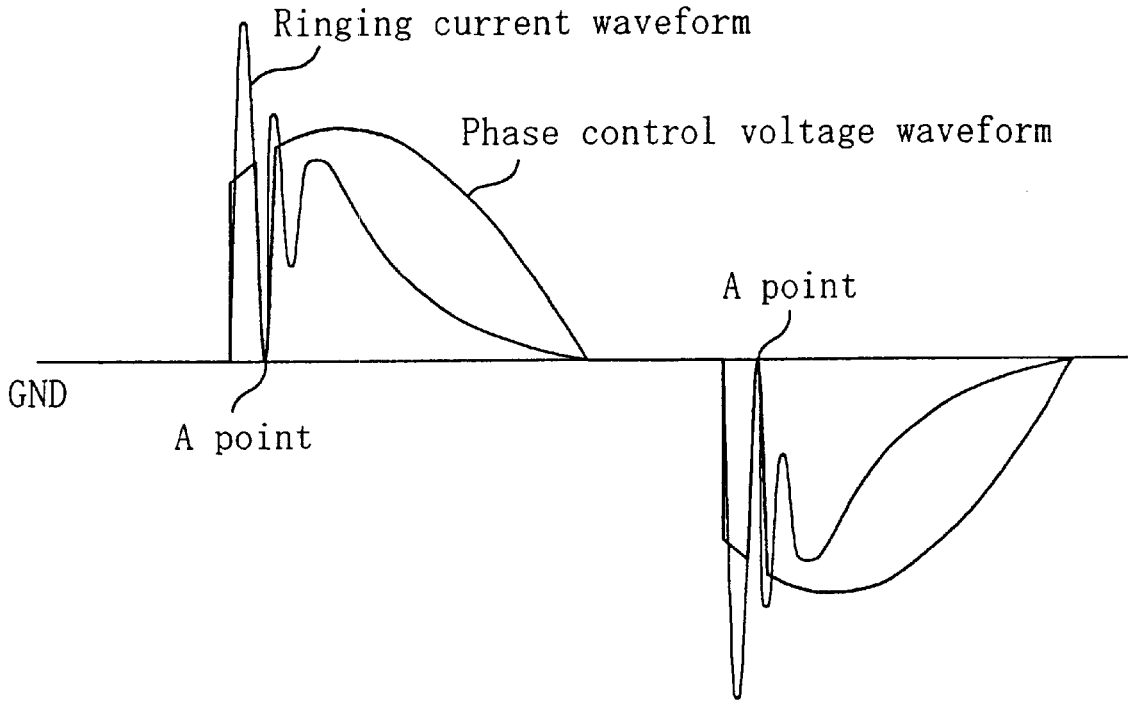
FIG. 4A is a waveform diagram showing input voltage-current waveforms (ringing current waveforms and phase-controlled waveforms at that time) of the ballast circuit.

When the resistor 14 is 0Ω (in the case of the configuration of FIG. 3), ringing current may flow, as shown in FIG. 4A. That is to say, at the moment when the triac 6 is turned on, the charges stored in the capacitor 12 between the input terminals of the ballast circuit 3 become inrush current into the inductance element 10 of the dimmer 2, and current that changes drastically up and down, as shown in FIG. 4A, (hereinafter, referred to as "ringing current) may flow from the dimmer 2 to the ballast circuit 3 due to the resonance phenomenon of the inductance element 10 of the dimmer 2 and the capacitor 12. The dimmer 2 is turned on and off at the point A in FIG. 4A, and as a result, the dimmer 2 is likely to malfunction. FIG. 4A also shows voltage waveforms between the input terminals of the ballast circuit 3 when the ringing current flows.

Figure 4B:
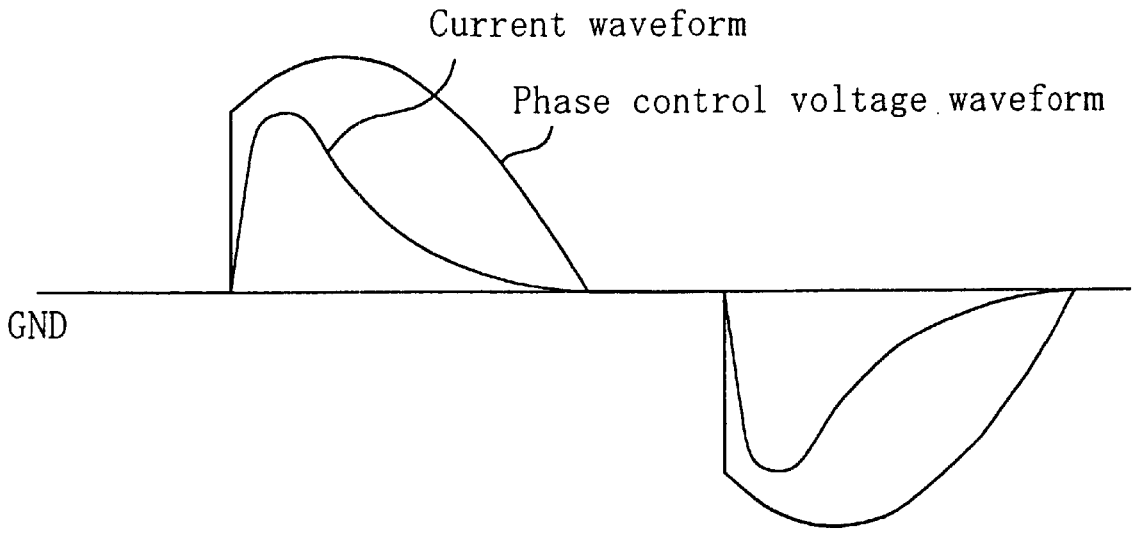
FIG. 4B is a waveform diagram showing input voltage-current waveforms (normal current waveforms and normal phase-controlled waveforms) of the ballast circuit.

On the other hand, as in the ballast circuit 3 shown in FIG. 1, when the resistor 14 is provided in series with the capacitor 12, the input current of the ballast circuit 3 has a mildly changed voltage waveform, as shown in FIG. 4B, so that there is no malfunction in the dimmer 2. More specifically, at the moment when the triac 6 is turned on, the resistor 14 restricts the charges stored in the capacitor 12 between the input terminals of the ballast circuit 3 from becoming inrush current into the dimmer 2, and thus the ringing current is prevented from being generated. In this case, the larger the value of the resistor 14, the larger effect of the ringing current prevention can be obtained.

Figure 5:
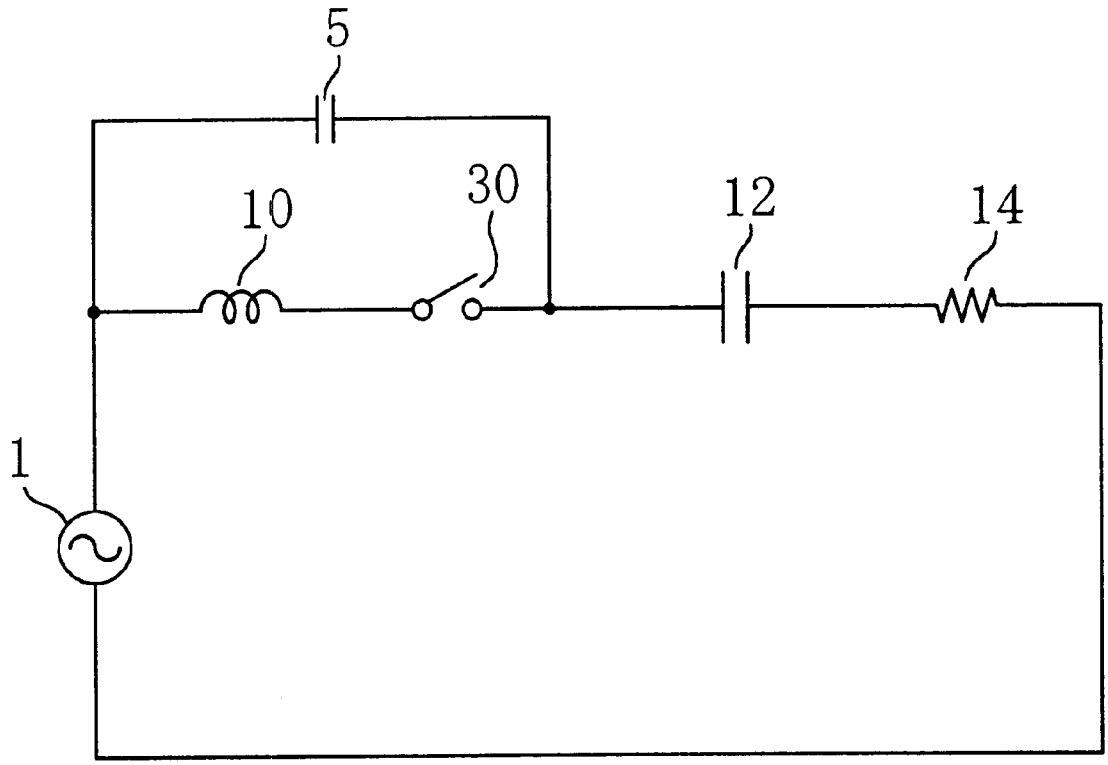
FIG. 5 is a circuit diagram for measuring a ringing current corresponding to the value of a resistor 14.

In order to confirm the ringing current prevention effect of the resistor 14, an experimental circuit shown in FIG. 5 was produced, and the ringing current with respect to the value of the resistor 14 was measured in this experimental circuit. The experiment circuit shown in FIG. 5 corresponds to a circuit in which the AC power source 1, the dimmer 2, the series circuit of the capacitor 12 and the resistor 14 in FIG. 1 are connected. Describing more specifically, in the circuit shown in FIG. 5, the inductance element 10 and a switch in place of the triac 6, and a series circuit of the capacitor 12 and the resistor 14 are connected to an AC power source 1, and further the capacitor 5 is connected to a series circuit of the inductance element 10 and the switch 30 in parallel.

In the circuit shown in FIG. 5, values generally used in a dimmer are used as the values of each element. For example, the inductance element 10 and the capacitor 5 have 50 pH and 0.33 μF, respectively, the capacitor 12 has 0.22 μF, and 60 Hz and 100 Vrms are used for the AC power source 1. Here, the switch 30 is turned on at a constant phase in the voltage waveform of the AC power source 1, and the ringing current flowing the series circuit of the capacitor 12 and the resistor 14 corresponding to the resistor 14 at that time was measured and the maximum amplitude value was obtained. As a result of the measurement, the values of the graph as shown in FIG. 6 were obtained.

Figure 6:
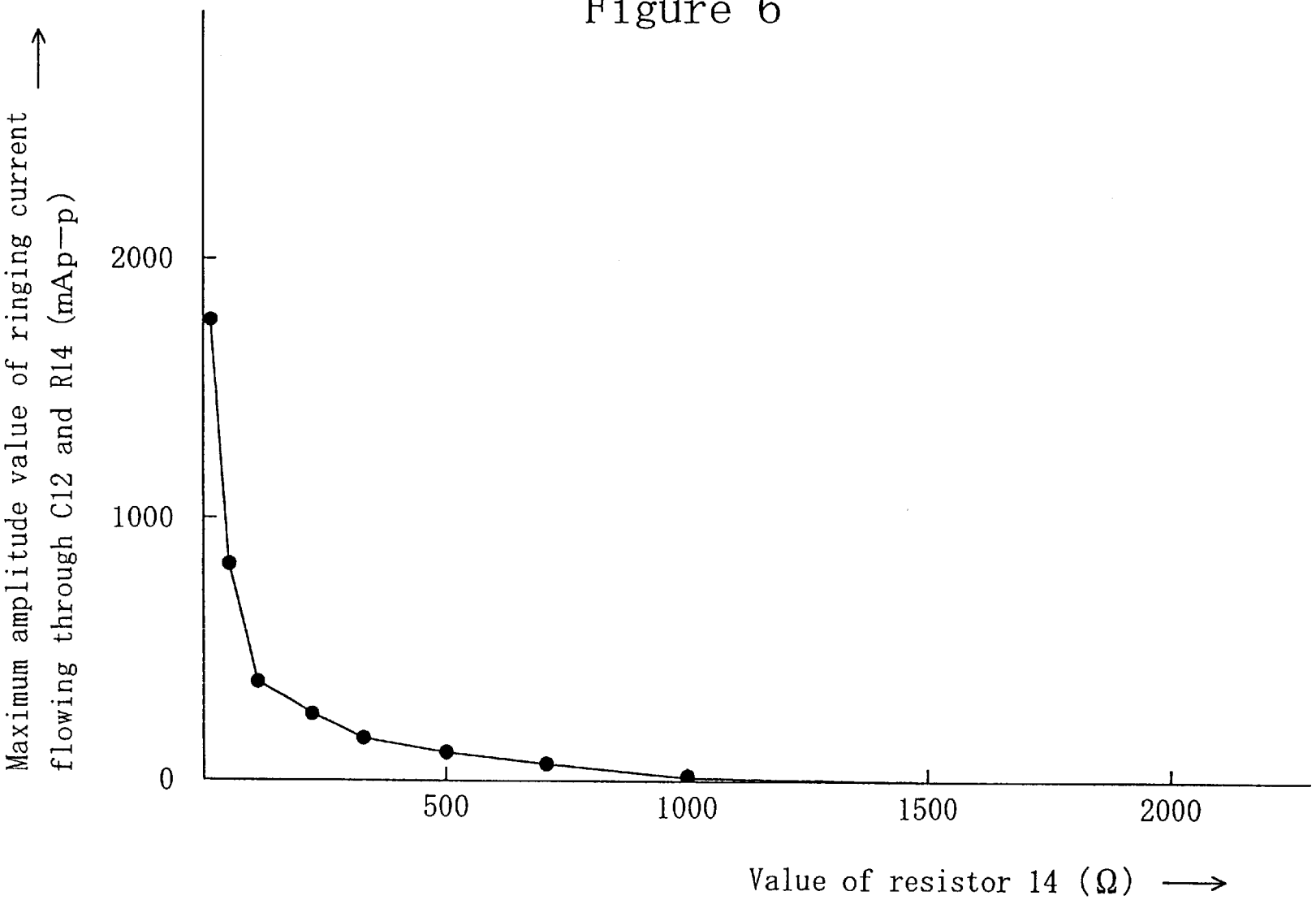
FIG. 6 is a graph showing a ringing current value corresponding to the value of a resistor 14.

FIG. 6 indicates that when the value of the resistor 14 is 1 KΩ or more, the maximum amplitude value of the ringing current is substantially 0, and the effect of preventing the generation of the ringing current can be obtained. Furthermore, the operation with the resistor 14 with 1 kΩ or more was examined by experiments by the inventors of the present invention, and then it was confirmed that the dimmer 2 was operated stably. Therefore, it is preferable that the value of the resistor 14 is 1 KΩ or more in view of ringing current prevention.

The value of input impedance Z2 between the input terminals of the ballast circuit 3 is set so as to satisfy the relationship $$Z2\leqq(Vin/Vob-1)\times Z1.$$

More specifically, it is set according to the above (i) to (iv). The input impedance Z2 can be determined by the synthesized impedance of the capacitor 12 and the resistor 14.

For example, the series impedance with 0.15 μF for the capacitor 12 and 15 KΩ for the resistor 14 is about 23 KΩ. That is to say, a stable operation of the dimmer 2 can be obtained and satisfactory dimming control is possible. Furthermore, in view of the high utility for general purposes and the high availability of the capacitor 12 having 0.12 μF to 0.22 μF, the operation with the capacitor 12 having 0.12 μF to 0.22 μF was examined with experiments. A stable operation of the dimmer 2 was confirmed in the following cases: in the case of 10 KΩ as the value of the resistor 14 when the capacitor 12 had 0.12 μF; and in the case of 20 KΩ as the value of the resistor 14 when the capacitor 12 had 0.22 μF.

Figure 7:
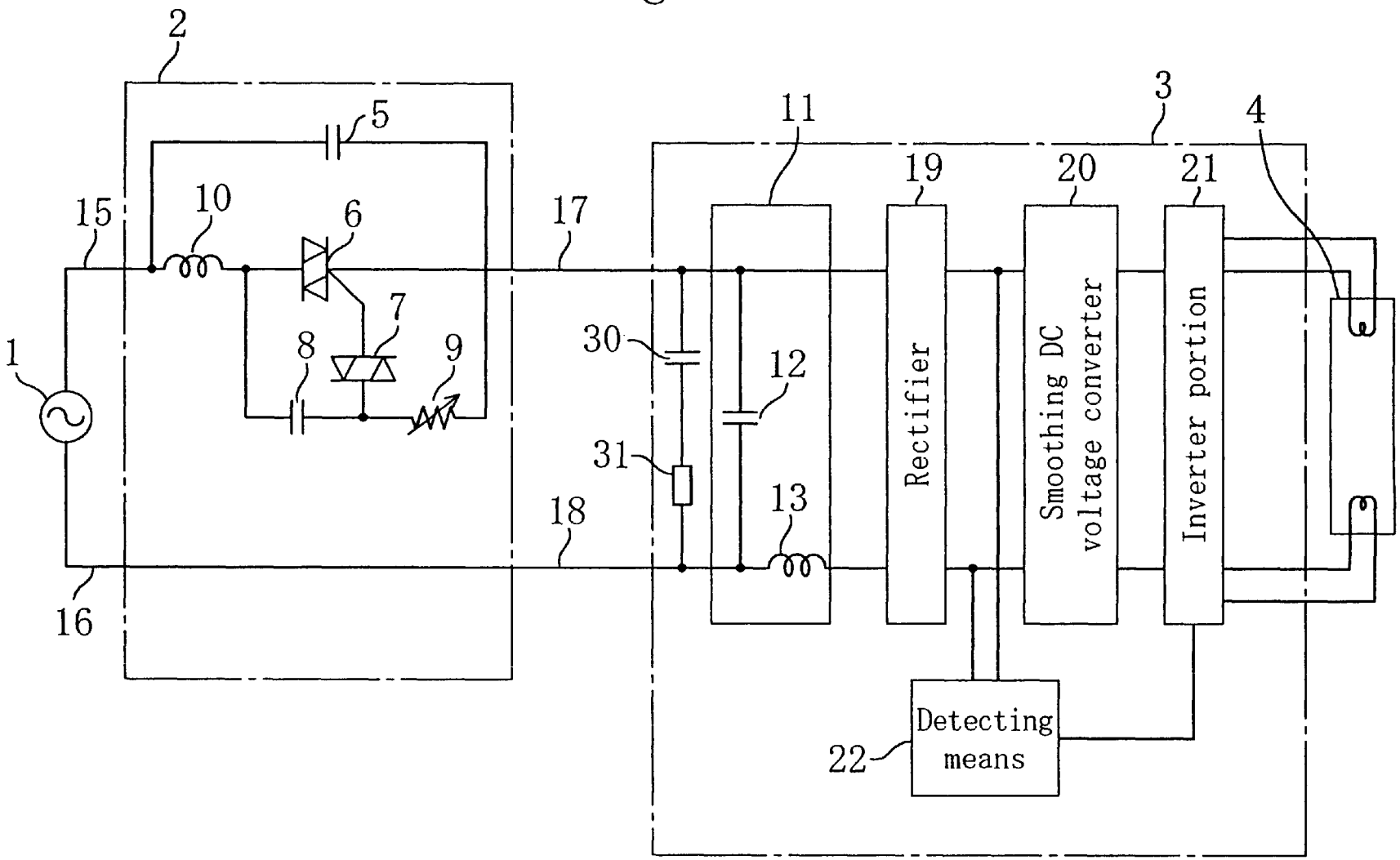
FIG. 7 is a view showing the configuration of a variation of the discharge lamp operating apparatus of an embodiment of the present invention.

In the configuration shown in FIG. 1, the series circuit of the capacitor 12 and the resistor 14 constituting the high frequency blocking filter 11 is connected between the input terminals of the ballast circuit 3, but the present embodiment is not limited thereto. As shown in FIG. 7, a series circuit of the capacitor 30 and a resistor 31 can be provided separately from the high frequency blocking filter 11. In particular, when the impedance of the input capacitor of the high frequency blocking filter 11 is sufficiently large, it is preferable that a series circuit of the capacitor 30 and a resistor 31 is connected separately from the high frequency blocking filter 11, as shown in FIG. 7, so that the input impedance of the ballast circuit is low.

Furthermore, the above embodiment has been described with 60 Hz and 100 Vrms for the AC power source 1. However, other frequencies and voltages such as 50 Hz and 100 Vrms can be used. The above embodiment has been described with 0.22 μF to 0.33 μF as the capacitance of the capacitor 5 of the dimmer 2. However, the present invention can apply to other dimmers with capacitances other than that.

The discharge lamp 4 of the discharge lamp operating apparatus of the present embodiment can be widely used for various types of discharge lamps such as fluorescent lamp, HID lamps (e.g., mercury lamps, metal halide lamps). In the case of fluorescent lamps, the present embodiment can apply to lamps having other shapes such as straight tube shape, spherical tube shape, curved shape or the like, for example, a lamp obtained by coupling U-shaped lamps with a bridge. In order to substitute for dimmable incandescent lamps, it is preferable that the ballast circuit 3 and the discharge lamp (fluorescent lamp) 4 of this embodiment are formed integrally so as to constitute a compact self-ballasted fluorescent lamp that can be mounted on a socket for an incandescent lamp without any modification.

Figure 8:
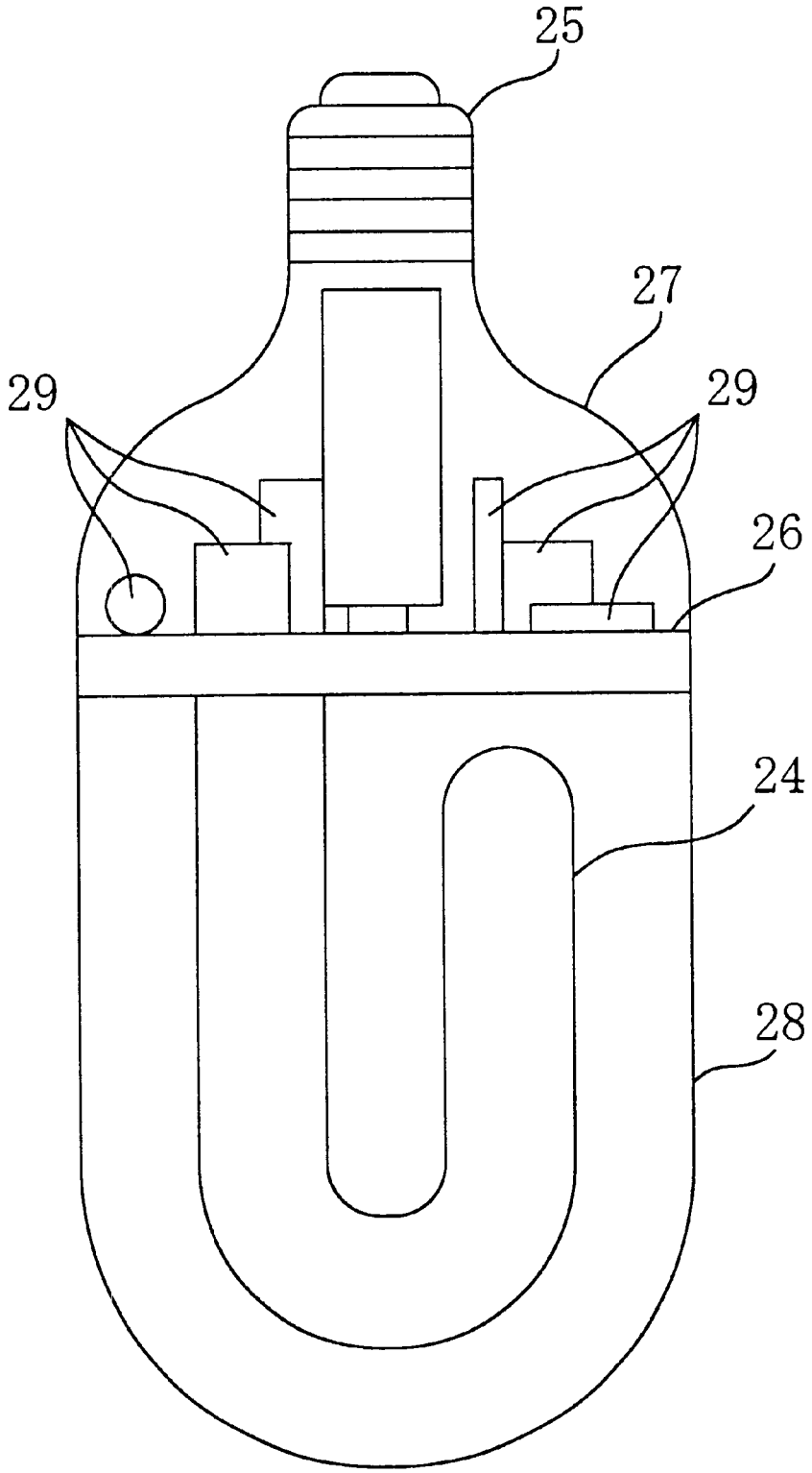
FIG. 8 is a schematic cross-sectional view showing the configuration of a self-ballasted discharge lamp of an embodiment of the present invention.
Figure 9:
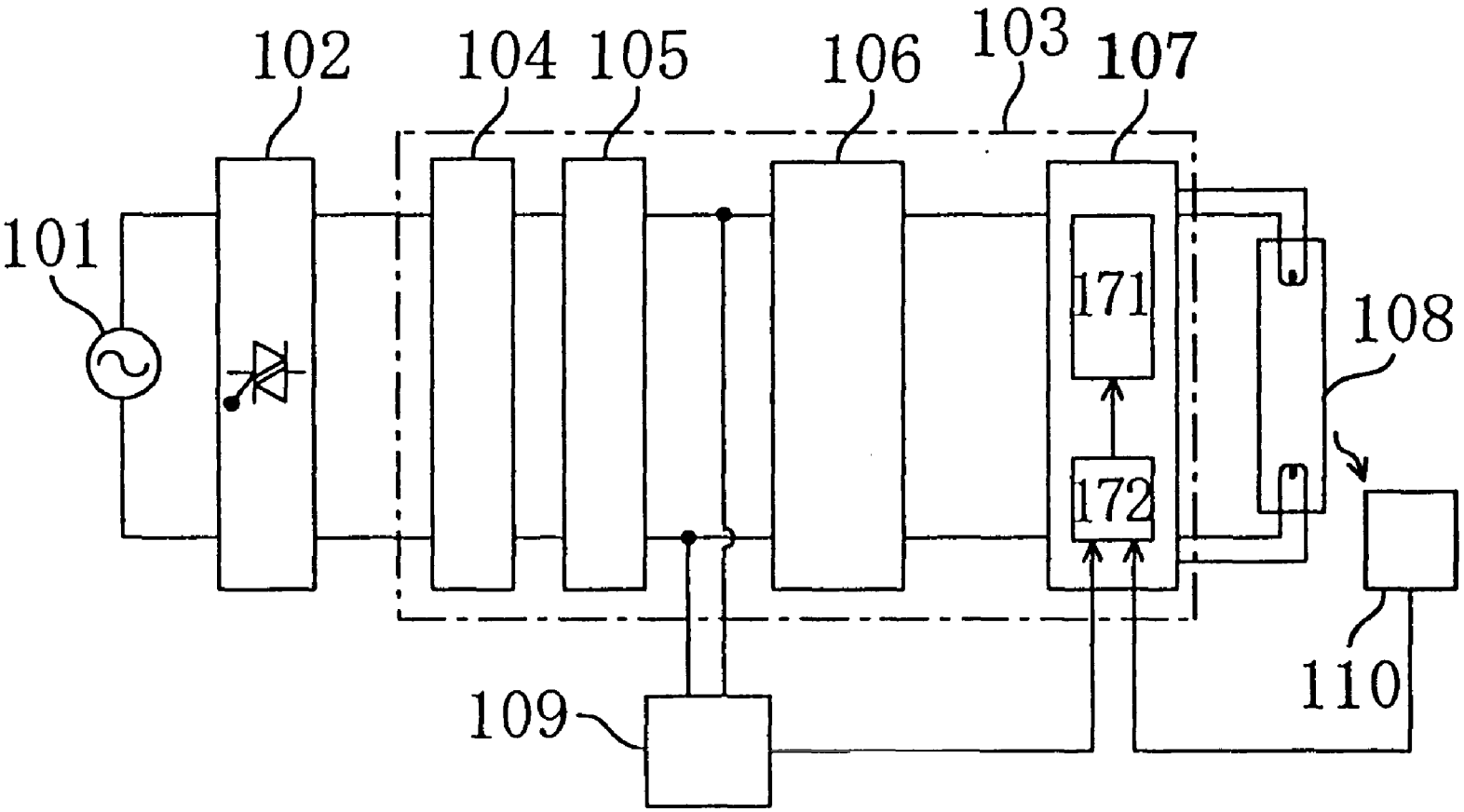
Figure 9 PRIOR ART
FIG. 9 is a view showing the configuration of a conventional discharge lamp operating apparatus.

FIG. 8 is a schematic view showing a self-ballasted discharge lamp (self-ballasted fluorescent lamp) of this embodiment. This self-ballasted discharge lamp has a bulb shape in which a ballast circuit 26 and a discharge lamp 24 are combined, and is provided with a lamp base 25 at one end of the bulb shape. Circuit components 29 are mounted on a circuit substrate of the ballast circuit 26, and a cover 27 is provided so as to cover the components. In addition, a globe 28 is provided so as to cover the discharge lamp 24. The self-ballasted discharge lamp shown in FIG. 8 is a 22 W class discharge lamp as an example.

The self-ballasted discharge lamp will be described more specifically below. The self-ballasted discharge lamp shown in FIG. 8 includes a fluorescent lamp 24 obtained by curving the shape of the discharge lamp (fluorescent lamp) 4 shown in FIG. 1, a lamp base 25, for example, of E26 type for incandescent lamps, a circuit substrate 26 in which wiring for the configuration of the ballast circuit 3 is formed and the circuit components 29 are attached, a cover 27 having the lamp base 25 attached at one end for accommodating the circuit substrate 26 inside, a translucent globe 28 provided so as to cover the circumference of the fluorescent lamp 24. The globe 28 can be eliminated. The lamp base can be one other than E26 for incandescent lamps. Although the circuit components 29 constituting the ballast circuit are attached onto the circuit substrate 26, only typical components are shown in FIG. 8.

Although not shown, the fluorescent lamp 24 and the circuit substrate 26 are electrically connected, and the circuit substrate 26 and the lamp base 25 are electrically connected. Power is supplied via the lamp base 25 by screwing the lamp into a socket for an incandescent lamp, so that the fluorescent lamp 24 is turned on. The AC voltage input through the lamp base 25 is an AC voltage that is phase-controlled by an external phase control apparatus (e.g., dimmer for incandescent lamps or the like, that is, the dimmer 2 of FIG. 1).

For dimming of the self-ballasted fluorescent lamp shown in FIG. 8 (or the discharge lamp operating apparatus of this embodiment), for example, a dimmer 2 provided on the wall of a room where the lamp is provided or a remote controllable dimmer 2 can be used for dimming. The ballast circuit (26 or 3) can be configured such that power supplied to the discharge lamp (24 or 4) can be varied continuously or varied discretely, and therefore dimming by the dimmer 2 may be performed continuously throughout the range of dimming instruction of 100% to 10%, or discretely (e.g., dimming instruction of 100%, 90%, . . . 10%). Continuous dimming is advantageous in that dimming can be performed arbitrarily, and discrete dimming is advantageous in that dimming can be performed for desired constant brightness in a simple manner. In this embodiment, either a volume phase control type dimmer or an electron phase control type dimmer can be used. In the case of an electron phase control type, a configuration provided with a function of storing brightness favored by a user (dimmer provided with a dimming memory function) can be achieved easily, so that an illumination fixture that satisfies the need of users can be realized.

Furthermore, the discharge lamp operating apparatus of this embodiment has high commercial value, not only in the form where the dimmer 2, the ballast circuit 3 and the discharge lamp 4 are electrically connected, but also in the form of the self-ballasted discharge lamp (FIG. 8) including the ballast circuit 3 and the discharge lamp 4, or in the form of the dimmer 2 alone, which can be distributed in the market. Moreover, an illumination set for dimming constituted by a set of a self-ballasted discharge lamp and a dimmer 2 can be distributed in the market. The illumination set for dimming not only can be used for an illumination component that has not been attached yet as an illumination fixture for houses or institutions, but also has commercial value in the form a table lamp or a floor-lamp stand for assembling as a set including a lamp.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A discharge lamp operating apparatus comprising:

a discharge lamp;

a dimmer for performing phase-control with respect to an input power source; and a ballast circuit for dimming and operating the discharge lamp in accordance with an AC voltage that is phase-controlled by the dimmer;

wherein a relationship $$Z2 \leqq (Vin/Vob-1) \times Z1$$

is satisfied, where Z1 (Ω) is an impedance between an input terminal and an output terminal of the dimmer, Vob (V) is a breakover voltage of a bidirectional trigger diode that applies a trigger signal and is connected to a gate terminal of a switching element included in the dimmer, Vin (V) is an effective voltage of a commercial power source, and Z2 (Ω) is an input impedance between the input terminals of the ballast circuit.

2. The discharge lamp operating apparatus according to claim 1, wherein an upper limit of the Z2 (Ω) is 54 KΩ.

3. The discharge lamp operating apparatus according to claim 1, wherein an upper limit of the Z2 (Ω) is 26 KΩ.

4. The discharge lamp operating apparatus according to claim 1, wherein a first capacitor is connected between the input terminals of the ballast circuit, and the first capacitor has a function of setting a value of the Z2 (Ω).

5. The discharge lamp operating apparatus according to claim 1, further comprising a lamp base, wherein the lamp base, the ballast circuit, and the discharge lamp are integrally formed.

6. The discharge lamp operating apparatus according to claim 1, wherein a series circuit including a second capacitor and a resistor is connected between the input terminals of the ballast circuit, and the series circuit has a function of setting a value of the Z2 (Ω).

7. The discharge lamp operating apparatus according to claim 6, wherein a lower limit of a resistance of the resistor is 1 KΩ.

8. The discharge lamp operating apparatus according to claim 6, wherein the ballast circuit comprises a high frequency blocking filter including an inductance element and a capacitor, and the second capacitor is the capacitor included in the high frequency blocking filter.

9. A discharge lamp operating apparatus, comprising:

a discharge lamp;

a dimmer for performing phase-control with respect to an input power source; and a ballast Circuit for dimming and operating the discharge lamp in accordance with an AC voltage that is phase-controlled by the dimmer;

wherein a series circuit including a capacitor and a resistor is connected between the input terminals of the ballast circuit, and the Series circuit has a function of preventing ringing current that can be generated during dimming, wherein the resistor has a resistance of 1 KΩ or more, and a relationship $$Z2 \leqq (Vin/Vob-1) \times Z1$$

is satisfied, where Z1 (Ω) is an impedance between an input terminal and an output terminal of the dimmer, Vob (V) is a breakover voltage of a bidirectional trigger diode that applies a trigger signal and is connected to a gate terminal of a switching element included in the dimmer, Vin CV) is an effective voltage of a commercial power source, and

Z2 (Ω) is an input impedance between the input terminals of the ballast circuit.

10. A self-ballasted discharge lamp comprising a discharge lamp, a ballast circuit and a lamp base that are integrally formed, wherein the self-ballasted discharge lamp is a lamp for dimming used in combination of a dimmer for performing phase control with respect to an input power source, the ballast circuit performs dimming and operation in accordance with an AC voltage that is phase-controlled by the dimmer, and a relationship $$Z2 \leqq (Vin/Vob-1) \times Z1$$

is satisfied, where Z1 (Ω) is an impedance between an input terminal and an output terminal of the dimmer, Vob (V) is a breakover voltage of a bidirectional trigger diode that applies a trigger signal and is connected to a gate terminal of a switching element included in the dimmer, Vin (V) is an effective voltage of a commercial power source, and

Z2 (Ω) is an input impedance between the input terminals of the ballast circuit.

11. The self-ballasted discharge lamp according to claim 10, wherein the discharge lamp is a fluorescent lamp having a phosphor in one portion thereof, an upper limit of the Z2 (Ω) is 54 KΩ, a series circuit including a capacitor and a resistor is connected between the input terminals of the ballast circuit, and the Z2 (Ω) is set by the series circuit, and a lower limit of a resistance of the resistor is 1 KΩ.

12. A dimmer for performing phase control with respect to an input power source, and supplying a phase-controlled AC voltage to a ballast circuit electrically connected to a discharge lamp, wherein a relationship $$Z2 \leqq (Vin/Vob-1) \times Z1$$

is satisfied, where Z1 (Ω) is an impedance between an input terminal and an output terminal of the dimmer, Vob (V) is a breakover voltage of a bidirectional trigger diode that applies a trigger signal and is connected to a gate terminal of a switching element included in the dimmer, Vin (V) is an effective voltage of a commercial power source, and

Z2 (Ω) is an input impedance between the input terminals of the ballast circuit.

13. An illumination set for dimming comprising:

a self-ballasted discharge lamp including a discharge lamp, a ballast circuit, and a lamp base that are integrally formed; and a dimmer combined with the self-ballasted discharge lamp, wherein the dimmer is an external phase control apparatus for performing phase control with respect to an input power source, and supplying a phase-controlled AC voltage to the ballast circuit, the ballast circuit in the self-ballasted discharge lamp has a configuration for performing dimming and operation in accordance with the AC voltage that is phase-controlled by the dimmer, and a relationship $$Z2 \leqq (Vin/Vob-1) \times Z1$$

is satisfied, where Z1 (Ω) is an impedance between an input terminal and an output terminal of the dimmer, Vob (V) is a breakover voltage of a bidirectional trigger diode that applies a trigger signal and is connected to a gate terminal of a switching element included in the dimmer, Vin (V) is an effective voltage of a commercial power source, and

Z2 (Ω) is an input impedance between the input terminals of the ballast circuit.

* * * * *

UNITED STATES PATENT AND TRADEMARK OFFICE

CERTIFICATE OF CORRECTION

PATENT NO. : 6,597,127 B2
DATED : July 22, 2003
INVENTOR(S) : Kenichiro Takahashi et al.

It is certified that error appears in the above-identified patent and that said Letters Patent is hereby corrected as shown below:

Column 11,
Line 31, "Vin CV)" should be -- Vin (V) --

Signed and Sealed this

First Day of June, 2004

JON W. DUDAS
*Acting Director of the United States Patent and Trademark Office*